US011508315B2

(12) United States Patent
Kim et al.

(10) Patent No.: US 11,508,315 B2
(45) Date of Patent: Nov. 22, 2022

(54) PIXEL SENSING CIRCUIT AND PIXEL SENSING METHOD

(71) Applicant: LX Semicon Co., Ltd., Daejeon (KR)

(72) Inventors: Young Bok Kim, Daejeon (KR); Won Kim, Daejeon (KR); Young Ho Shin, Daejeon (KR)

(73) Assignee: LX Semicon Co., Ltd., Daejeon (KR)

( * ) Notice: Subject to any disclaimer, the term of this patent is extended or adjusted under 35 U.S.C. 154(b) by 0 days.

(21) Appl. No.: 17/537,073

(22) Filed: Nov. 29, 2021

(65) Prior Publication Data

US 2022/0180817 A1 Jun. 9, 2022

(30) Foreign Application Priority Data

Dec. 3, 2020 (KR) ..... 10-2020-0167559

(51) Int. Cl.
*G09G 3/3283* (2016.01)
*G09G 3/3233* (2016.01)

(52) U.S. Cl.
CPC ..... *G09G 3/3283* (2013.01); *G09G 3/3233* (2013.01); *G09G 2300/0842* (2013.01); *G09G 2310/061* (2013.01); *G09G 2310/08* (2013.01); *G09G 2330/12* (2013.01)

(58) Field of Classification Search
CPC ..... G09G 3/3283; G09G 3/3233; G09G 2320/045; G09G 2300/0842; G09G 2310/061; G09G 2310/08; G09G 2330/12
USPC ..... 345/214, 76
See application file for complete search history.

(56) References Cited

U.S. PATENT DOCUMENTS

| | | | | |
|---|---|---|---|---|
| 10,249,248 | B2 | 4/2019 | Lee et al. | |
| 2011/0164010 | A1 | 7/2011 | Yamamoto et al. | |
| 2018/0137819 | A1* | 5/2018 | An | G09G 3/3233 |
| 2018/0174522 | A1 | 6/2018 | Lee et al. | |
| 2020/0202787 | A1* | 6/2020 | Do | G09G 3/3233 |

FOREIGN PATENT DOCUMENTS

| | | | |
|---|---|---|---|
| KR | 10-2018-0071469 | A | 6/2018 |
| KR | 10-2020-0061655 | A | 6/2020 |
| KR | 10-2020-0067527 | A | 6/2020 |
| KR | 10-2156784 | B1 | 9/2020 |

* cited by examiner

*Primary Examiner* — Jimmy H Nguyen
(74) *Attorney, Agent, or Firm* — Fenwick & West LLP

(57) ABSTRACT

An embodiment relates to a pixel sensing circuit and a pixel sensing method and, more particularly, to a pixel sensing circuit and a pixel sensing method for reducing the size of a source driver IC by sharing some components in a pixel sensing circuit and for sensing a pixel using a pixel sensing circuit in which some components are shared.

11 Claims, 14 Drawing Sheets

PIXEL SENSING CIRCUIT AND PIXEL SENSING METHOD

CROSS-REFERENCE TO RELATED APPLICATIONS

This application claims priority from Republic of Korea Patent Application No. 10-2020-0167559, filed on Dec. 3, 2020, which is hereby incorporated by reference for all purposes as if fully set forth herein.

BACKGROUND

1. Field of Technology

The present embodiment relates to a pixel sensing circuit and a pixel sensing method.

2. Description of the Prior Art

Generally, an organic light-emitting diode (OLED) display device is a display device that displays a desired image by individually supplying data voltages according to image information to OLED pixels disposed in a matrix form to thereby control the pixels.

A panel applied to the OLED display device, that is, a display panel in which OLED pixels are disposed, has an increasing range of applications due to lightness, slimness, and low-power driving.

Each pixel includes an organic light-emitting diode (OLED), a driving thin-film transistor (TFT), and the like. As the driving time of the pixels increases, the driving characteristics of the organic light-emitting diode or the TFT, that is, the electrical characteristics of the pixels, change. This change in the electrical characteristics may occur differently depending on the pixels. When the electrical characteristics of the pixels are different, a brightness difference occurs even between pixels supplied with the same data voltage, thus degrading the image quality of the OLED display device.

To prevent the degradation of the image quality of the OLED display device, it is necessary to compensate for the change in the electrical characteristics of the pixels.

An external compensation technique is known as a method for compensating for the change in the electrical characteristics of the pixels.

To implement the external compensation technique in the OLED display device, it is necessary to mount a pixel sensing circuit in a source driver integrated circuit (IC) of the OLED display device.

Generally, there is a plurality of sensing channels in the source driver IC, and the pixel sensing circuit includes a plurality of sensing channel circuits connected to the respective sensing channels, causing an increase in the size of the pixel sensing circuit.

Accordingly, an area occupied by the pixel sensing circuit in the source driver IC is increased, thus increasing the chip size and manufacture costs of the source driver IC.

SUMMARY OF THE INVENTION

With this background, the present disclosure is to provide a technique for reducing the size of a source driver IC by sharing some components in a pixel sensing circuit and for sensing a pixel using a pixel sensing circuit in which some components are shared.

In view of the foregoing, an embodiment provides a pixel sensing circuit including: at least two sensing channels configured to include a first sensing channel connected to a first sensing line on a display panel and a second sensing channel connected to a second sensing line on the display panel; a current integrator circuit configured to output a first integral value by integrating a pixel current characteristic input through the first sensing channel and then to output a second integral value by integrating a pixel current characteristic input through the second sensing channel; and at least two sample-and-hold circuits configured to be connected in parallel with an output portion of the current integrator circuit and to be connected with the at least two sensing channels one-to-one.

Another embodiment provides a method for sensing pixels on a display panel by a source driver integrated circuit (IC), the method including: a first input operation of receiving current characteristics of a (1-1)th pixel column group, which is a first pixel column group in a first horizontal line, through a first sensing channel group in a vertical blank period of a first frame; a first sensing operation of sensing the current characteristics of the (1-1)th pixel column group; an Nth input operation of receiving current characteristics of an (n−1)th pixel column group (where n is a natural number equal to N), which is a first pixel column group in an nth horizontal line, through the first sensing channel group in a vertical blank period of an Nth frame (where N is a natural number equal to or greater than 2); an Nth sensing operation of sensing the current characteristics of the (n−1)th pixel column group; an (N+1)th input operation of receiving current characteristics of a (1-2)th pixel column group, which is a second pixel column group in the first horizontal line, through a second sensing channel group in a vertical blank period of an (N+1)th frame; and an (N+1)th sensing operation of sensing the current characteristics of the (1-2)th pixel column group.

As described above, according to an embodiment, since a current integrator circuit is shared in a pixel sensing circuit, it is possible to reduce the size of the pixel sensing circuit. Further, it is also possible to reduce the size of a source driver IC including the pixel sensing circuit and manufacture costs thereof.

DETAILED DESCRIPTION OF THE EXEMPLARY EMBODIMENTS

Figure 1:
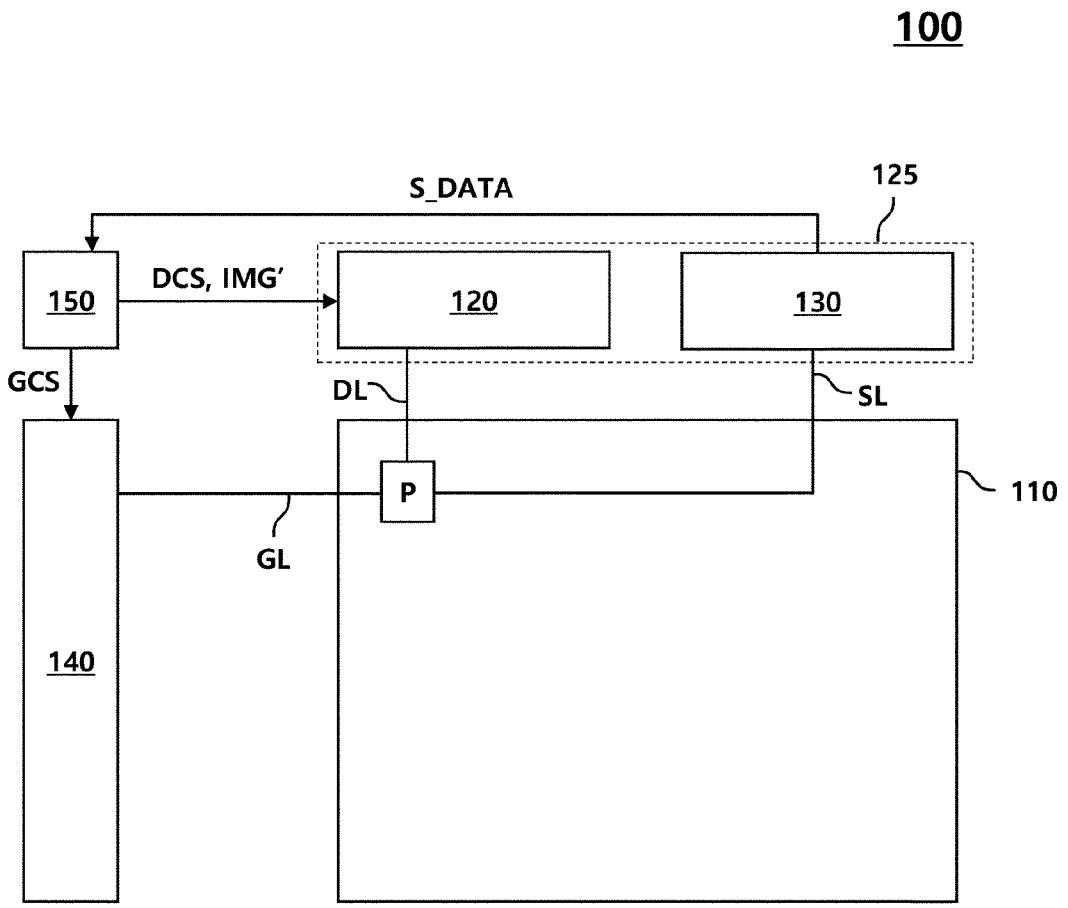
FIG. 1 illustrates the configuration of a general display device.

FIG. 1 illustrates the configuration of a general display device.

Referring to FIG. 1, the general display device 100 may include a display panel 110 and a panel driving device 120, 130, 140, and 150 to drive the display panel 110.

Figure 3:
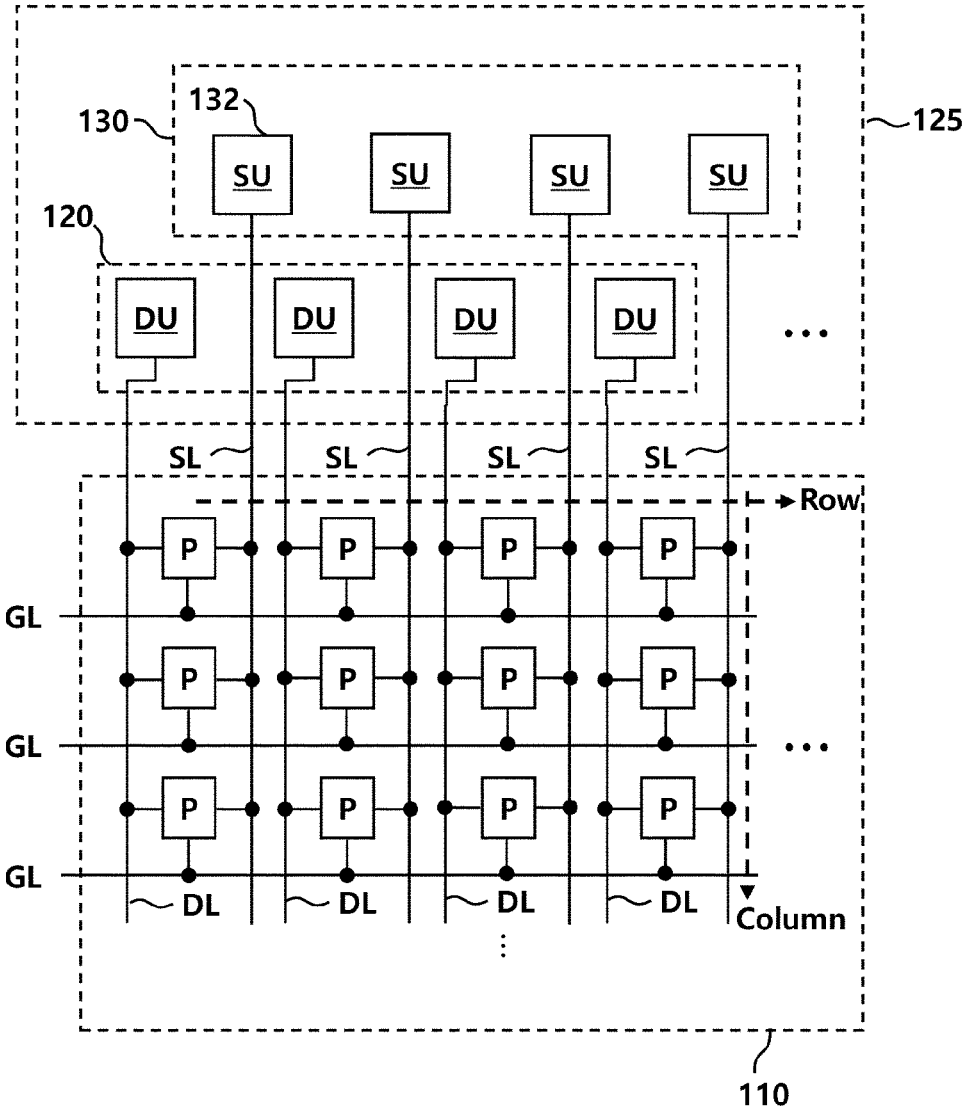

On the display panel 110, a plurality of data lines DL, a plurality of gate lines GL, and a plurality of sensing lines SL may be disposed, and a plurality of pixels P may be disposed. Here, the plurality of pixels P may be disposed in the form of a matrix including a plurality of rows and a plurality of columns as illustrated in FIG. 3.

Devices 120, 130, 140, and 150 to drive at least one component included in the display panel 110 may be referred to as the panel driving device. For example, a data driving circuit 120, a pixel sensing circuit 130, a gate driving circuit 140, a data processing circuit 150, and the like may be referred to as the panel driving device.

Each of the devices 120, 130, 140, and 150 may be referred to as the panel driving device, or all or a plurality of devices thereof may be referred to as the panel driving device.

In the panel driving device, the gate driving circuit 140 may supply a scan signal of a turn-on voltage or a turn-off voltage to a gate line GL. When a scan signal of a turn-on voltage is supplied to a pixel P, the pixel P is connected to a data line DL, and when a scan signal of a turn-off voltage is supplied to a pixel P, the pixel P is disconnected from a data line DL.

Here, the gate driving circuit 140 may be referred to as a gate driver integrated circuit (IC). Although FIG. 1 shows only one gate driving circuit 140, the general display device 100 may actually include one or more gate driving circuits 140.

In the panel driving device, the data driving circuit 120 supplies a data voltage to a data line DL. The data voltage supplied to the data line DL is transmitted to a pixel P connected to the data line DL according to a scan signal.

In the panel driving device, the pixel sensing circuit 130 receives an analog signal, for example, a voltage, a current, or the like, formed in each pixel P. The pixel sensing circuit 130 may be connected to each pixel P according to a scan signal or may be connected to each pixel P according to a separate sensing signal. The separate sensing signal may be generated by the gate driving circuit 140.

The pixels P may include an organic light emitting diode OLED and at least one transistor. The characteristics of the organic light emitting diode OLED and the transistor included in each pixel P may change according to time or surroundings. Generally, the pixel sensing circuit 130 may sense characteristics of these components included in each pixel P and may transmit the sensed characteristics to the data processing circuit 150 to be described.

Figure 2:
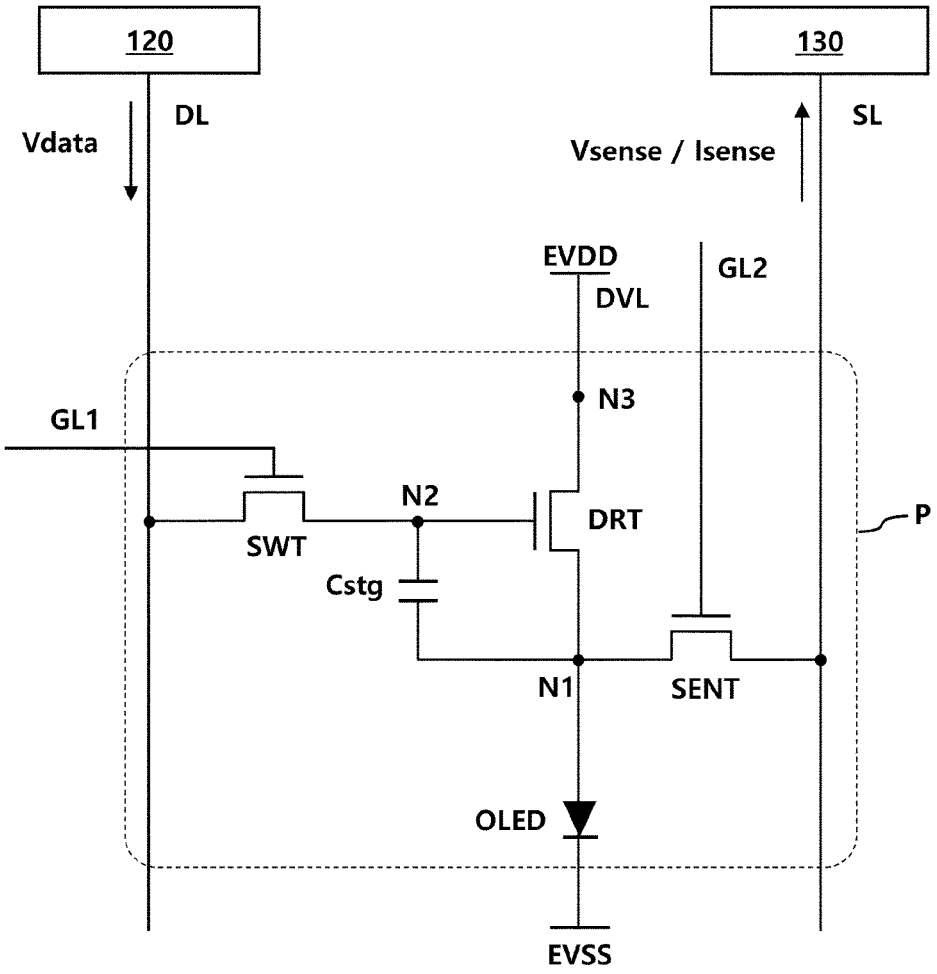
FIG. 2 and FIG. 3 illustrate the configuration of a general display panel and the configuration of a general source driver IC.

Specifically, as illustrated in FIG. 2, each pixel P may include an organic light emitting diode OLED, a driving transistor DRT, a switching transistor SWT, a sensing transistor SENT, and a storage capacitor Cstg.

The organic light emitting diode OLED may include an anode electrode, an organic layer, and a cathode electrode. According to the control of the driving transistor DRT, the anode electrode is connected to a driving voltage EVDD and the cathode electrode is connected to a base voltage EVSS, thus emitting light. That is, when the driving transistor DRT is turned on, a driving current may be supplied from the driving voltage EVDD to enable the organic light emitting diode OLED to emit light, and a voltage may be formed between the anode electrode and the cathode electrode according to characteristics of the organic light emitting diode OLED.

The driving transistor DRT may control the driving current supplied to the organic light emitting diode OLED, thereby controlling the brightness of the organic light emitting diode OLED.

A first node N1 of the driving transistor DRT may be electrically connected to the anode electrode of the organic light emitting diode OLED, and may be a source node or a drain node. A second node N2 of the driving transistor DRT may be electrically connected to a source node or a drain node of the switching transistor SWT, and may be a gate node. A third node N3 of the driving transistor DRT may be electrically connected to a driving voltage line DVL supplying the driving voltage EVDD, and may be a drain node or a source node.

The switching transistor SWT may be electrically connected to a data line DL and the second node N2 of the driving transistor DRT, and may be turned on by receiving a scan signal through gate lines GL1 and GL2.

When the switching transistor SWT is turned on, a data voltage Vdata supplied from the data driving circuit 120 through the data line DL is transmitted to the second node N2 of the driving transistor DRT.

The storage capacitor Cstg may be electrically connected to the first node N1 and the second node N2 of the driving transistor DRT.

The storage capacitor Cstg may be a parasitic capacitor disposed between the first node N1 and the second node N2 of the driving transistor DRT, or may be an external capacitor intentionally designed outside the driving transistor DRT.

The sensing transistor SENT may connect the first node N1 of the driving transistor DRT and a sensing line SL, and the sensing line SL may transmit a reference voltage Vref to the first node N1, and may transmit an analog signal, for example, a voltage or current, formed in the first node N1 to the pixel sensing circuit 130.

The pixel sensing circuit 130 measures characteristics of the pixel P using an analog signal Vsense or Isense transmitted through the sensing line SL.

Measuring the voltage of the first node N1 makes it possible to identify the threshold voltage of the driving transistor DRT, mobility, and current characteristics. Further, measuring the voltage of the first node N1 makes it possible to identify the degree of deterioration of the organic light emitting diode OLED, such as the parasitic capacitance and current characteristics of the organic light emitting diode OLED.

The pixel sensing circuit 130 may measure the voltage of the first node N1, that is, a characteristic value of the pixels P, and may transmit pixel sensing data, which is digital data including the characteristic value, to the data processing circuit (see 150 in FIG. 1). The data processing circuit (see 150 in FIG. 1) may identify a characteristic of each pixel P using the pixel sensing data.

The data driving circuit 120 and the pixel sensing circuit 130 may be included in a single integrated circuit 125. The single integrated circuit 125 may be referred to as a source driver IC.

Although FIG. 1 shows only one source driver IC 125, the general display device 100 may actually include one or more one source driver ICs 125.

In the panel driving device, the data processing circuit 150 may supply various control signals to the gate driving circuit 140 and the data driving circuit 120. The data processing circuit 150 may generate a gate control signal GCS for starting a scan according to a timing configured in each frame and may transmit the generated gate control signal GCS to the gate driving circuit 140. The data processing circuit 150 may output image data IMG', obtained by converting image data (IMG) input from an external device according to a data signal format used by the data driving circuit 120, to the data driving circuit 120. Further, the data processing circuit 150 may transmit a data control signal DCS for controlling the data driving circuit 120 to supply a data voltage to each pixel P according to each timing.

The data processing circuit 150 may calibrate and transmit image data IMG' according to a characteristic of a pixel P. Here, the data processing circuit 150 may receive pixel sensing data S_DATA from the pixel sensing circuit 130. The data processing circuit 150 may generate calibrated value data using the pixel sensing data S_DATA and may calibrate the image data IMG' using the calibrated value data. The pixel sensing data S_DATA may include the characteristic value of the characteristic of the pixel P.

The data processing circuit 150 may be referred to as a timing controller.

As illustrated in FIG. 3, the data driving circuit 120 included in the source driver IC 125 in the general display device 100 includes a plurality of data channel circuits DU connected to the data lines DL on the display panel 110, and the pixel sensing circuit 130 includes a plurality of sensing channel circuits SU connected to the sensing lines SL, thus causing an increase in the area of the source driver IC 125.

Figure 4:
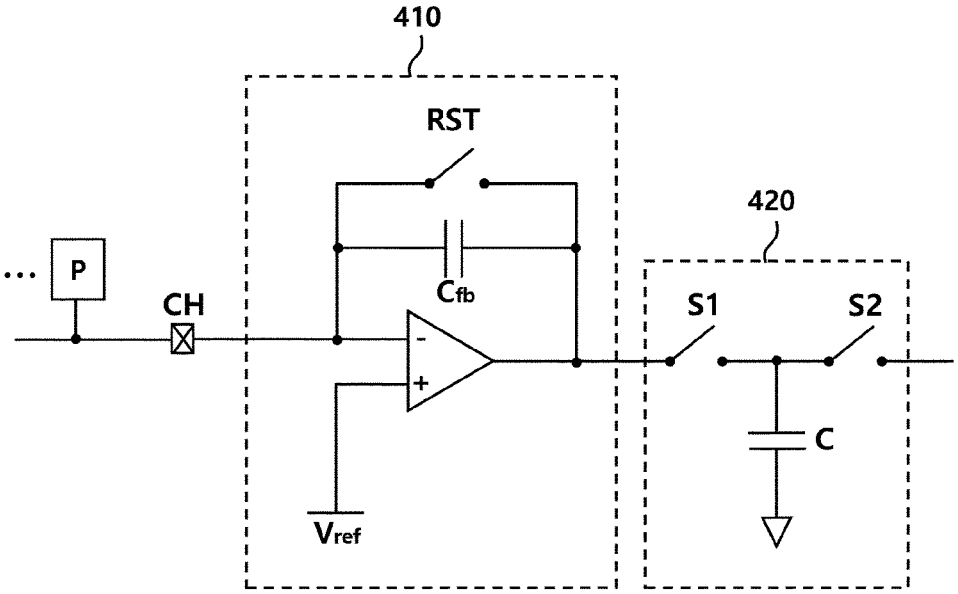
FIG. 4 illustrates the configuration of a general sensing channel circuit.

Further, in the general pixel sensing circuit 130, a current integrator circuit 410 is included in each of the plurality of sensing channel circuits SU as illustrated in FIG. 4, thus causing an increase in the chip size of the source driver IC and an increase in manufacture costs.

In an embodiment, some components may be shared between the plurality of sensing channel circuits included in the pixel sensing circuit in order to reduce the size of the source driver IC.

A relevant description is specifically made as follows.

Figure 5:
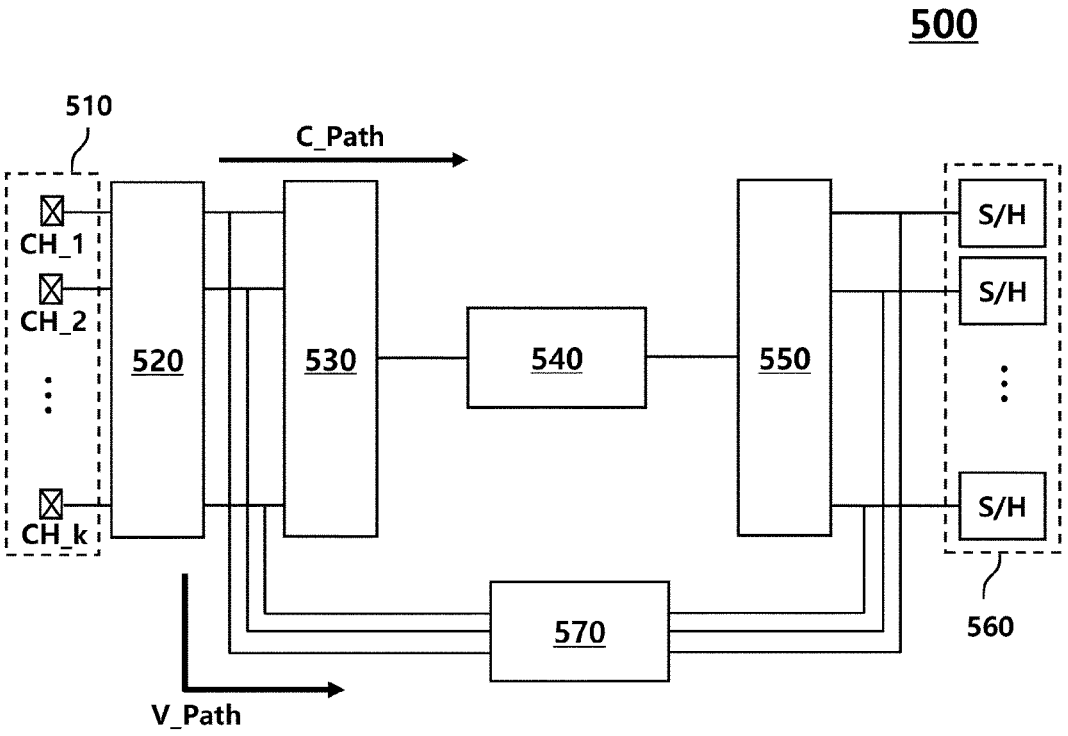
FIG. 5 is a block diagram schematically illustrating the configuration of a pixel sensing circuit according to an embodiment.
Figure 6:
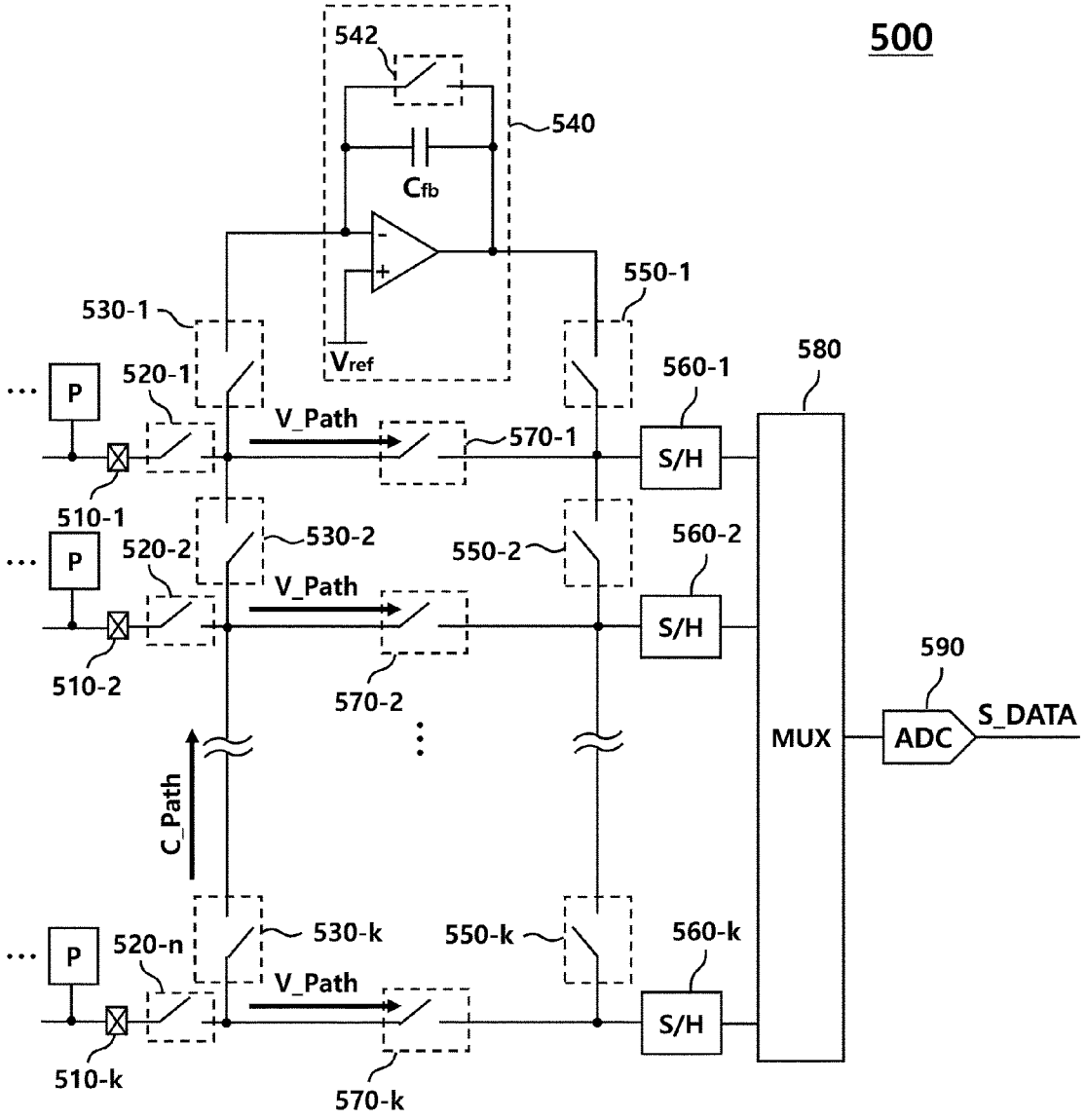
FIG. 6 specifically illustrates the configuration of a pixel sensing circuit according to an embodiment.

FIG. 5 is a block diagram schematically illustrating the configuration of a pixel sensing circuit according to an embodiment, and FIG. 6 specifically illustrates the configuration of the pixel sensing circuit according to the embodiment.

The pixel sensing circuit 500 according to the embodiment may include a plurality of sensing channels 510, a channel switch circuit 520, a current input switch circuit 530, a common current integrator circuit 540, an integral output switch circuit 550, a plurality of sample-and-hold circuits 560, and a voltage sensing switch circuit 570. In addition, as illustrated in FIG. 6, the pixel sensing circuit 500 may further include a multiplexer 580 and an analog-to-digital converter 590.

In an embodiment, the pixel sensing circuit 500 may operate in a current sensing mode of sensing a pixel current characteristic of pixels disposed on a display panel or in a voltage sensing mode of sensing a pixel voltage characteristic of the pixels. That is, the pixel sensing circuit 500 may operate in the current sensing mode in which the common current integrator circuit 540 sequentially outputs a plurality of integral values or in the voltage sensing mode in which the plurality of sample-and-hold circuits 560 samples and holds a plurality of pixel voltage characteristics.

The plurality of sensing channels 510 may be connected to a plurality of sensing lines disposed on the display panel.

That is, as illustrated in FIG. 6, the plurality of sensing channels 510 may include a first sensing channel 510-1 connected to a first sensing line on the display panel, a second sensing channel 510-2 connected to a second sensing line on the display panel, and a kth sensing channel **510-*k*** connected to a kth sensing line on the display panel (where k is a natural number equal to or greater than 2).

As illustrated in FIG. 6, the channel switch circuit 520 may include a first channel switch 520-1 and a second channel switch 520-2 to a kth channel switch **520-*k*, and may electrically disconnect or connect the plurality of sensing channels 510 and a current sensing path C_Path or may electrically disconnect or connect the plurality of sensing channels 510** and a voltage sensing path V_Path.

First, in the current sensing mode, the channel switch circuit 520 may time-divisionally connect the plurality of sensing channels 510 to the current sensing path C_Path.

Figure 7:
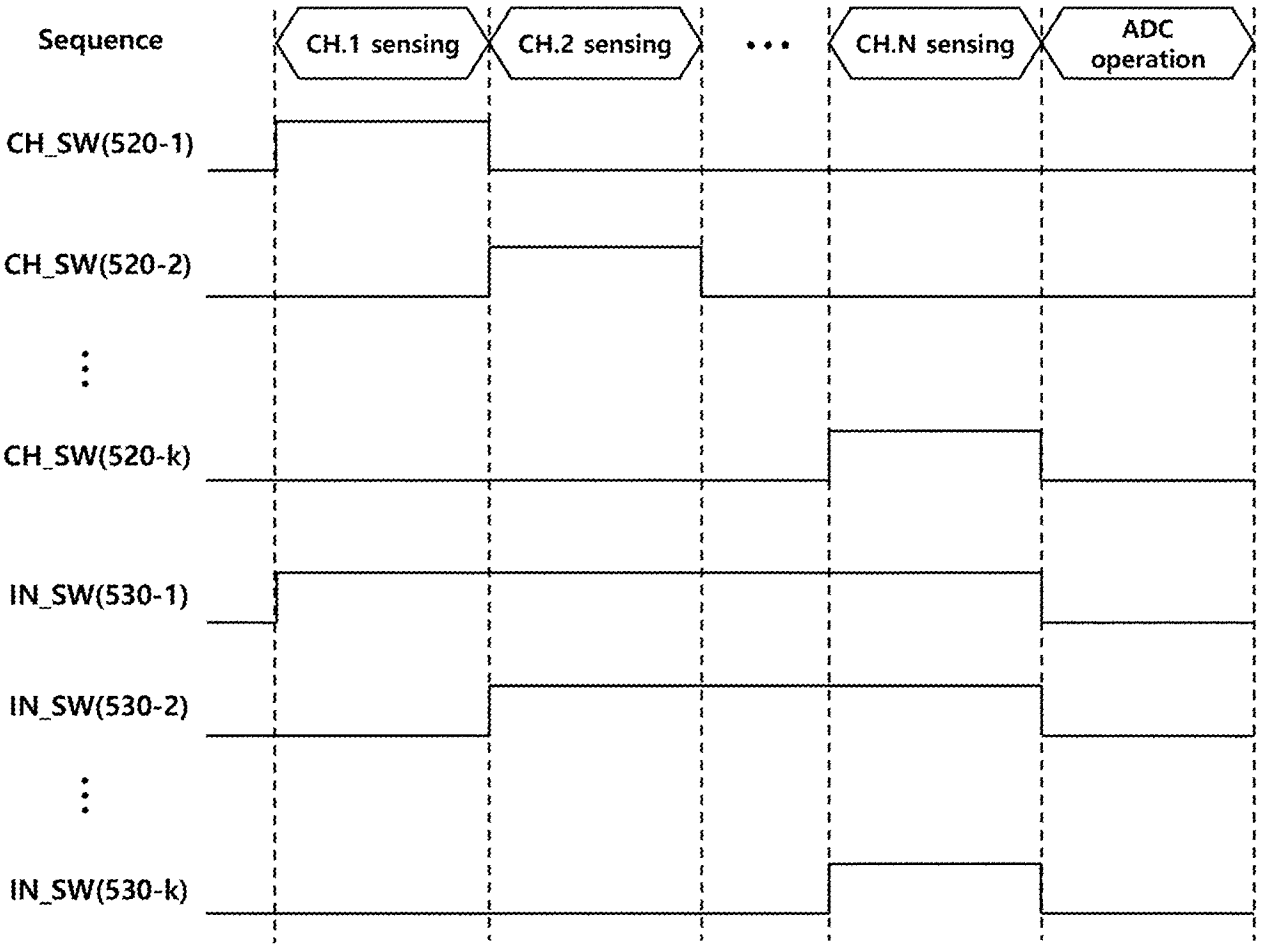
FIGS. 7, 8, and 9 illustrate the operation of a pixel sensing circuit in a current sensing mode according to an embodiment.

Specifically, in the current sensing mode, as illustrated in FIG. 7, the first channel switch 520-1 of the channel switch circuit 520 is closed for a specified time (CH.1 sensing period) to connect the first sensing channel 510-1 and the current sensing path C_Path for the specified time, and when the specified time elapses, the first channel switch 520-1 is open.

When the first channel switch 520-1 is closed for the specified time, the remaining channel switches maintain an open state.

Immediately after the first channel switch 520-1 is open, the second channel switch 520-2 is closed for a specified time (CH.2 sensing period of FIG. 7) to connect the second sensing channel 510-2 and the current sensing path C_Path for the specified time, and when the specified time elapses, the second channel switch 520-2 is open.

Likewise, when the second channel switch 520-2 is closed for the specified time, the remaining channel switches maintain the open state.

The kth channel switch **520-*k*, which is the last switch of the channel switch circuit 520, may be configured as described above, thereby time-divisionally connecting the kth sensing channel 510-*k*** to the current sensing path C-Path.

In the voltage sensing mode, the channel switch circuit 520 may be closed to simultaneously connect all of the plurality of sensing channels 510 to the voltage sensing path V_Path.

As illustrated in FIG. 6, the current input switch circuit 530 may include a first current input switch 530-1 and a second current input switch 530-2 to a kth current input switch **530-*k*. Here, one portion of the first current input switch 530-1 may be connected to an input portion, that is, an inverting input terminal (−), of the common current integrator circuit 540, and the other portion of the first current input switch 530-1 may be connected to one portion of the second current input switch 530-2. The other portion of the second current input switch 530-2** may be connected to one portion of the third current input switch (not shown).

According to an embodiment, in the current sensing mode, the current input switch circuit 530 may electrically connect the plurality of sensing channels 510 and the current sensing path C_Path and may then electrically disconnect the same. Here, the current input switch circuit 530 may sequentially connect the plurality of sensing channels and the current sensing path C_Path and may then simultaneously disconnect the same.

In the voltage sensing mode, the current input switch circuit 530 may electrically disconnect the plurality of sensing channels 510 and the current sensing path C_Path.

Specifically, as illustrated in FIG. 7, in the current sensing mode, at a time when the first channel switch 520-1 is closed, the first current input switch 530-1 may also be closed. Then, the first current input switch 530-1 may continuously maintain a closed state, and may be open at a time when the kth channel switch **520-*k* is opened. That is, the first current input switch 530-1** may be electrically closed in the current sensing mode.

In FIG. 7, at a time when the second channel switch 520-2 is closed, the second current input switch 530-2 may also be closed. Then, the second current input switch 530-2 may continuously maintain a closed state, and may be open at a time when the kth channel switch **520-*k*** is open.

In FIG. 7, at a time when the kth channel switch **520-*k*, which is the last switch of the channel switch circuit 520, is closed, the kth current input switch 530-*k* may also be closed. Then, when the kth channel switch 520-*k* is opened after a lapse of a specified time (CH.k sensing section of FIG. 7), the kth current input switch 530-*k*** may also be open.

When the channel switch circuit 520 and the current input switch circuit 530 operate as above in the current sensing mode, a plurality of pixel current characteristics input to the plurality of sensing channels 510 may be sequentially input to the current integrator circuit 540 through the current sensing path C_Path.

That is, when the first channel switch 520-1 and the first current input switch 530-1 are closed, a pixel current characteristic input through the first sensing channel 510-1 is input to the common current integrator circuit 540. Subsequently, when the second channel switch 520-2 and the second current input switch 530-2 are closed, a pixel current characteristic input through the second sensing channel 510-2 is input to the common current integrator circuit 540. Here, the pixel current characteristic may include a source-drain current flowing in a driving transistor (DRT of FIG. 2) included in a pixel.

The common current integrator circuit 540 may sequentially integrate the plurality of pixel current characteristics sequentially input through the current sensing path C_Path.

Figure 8:
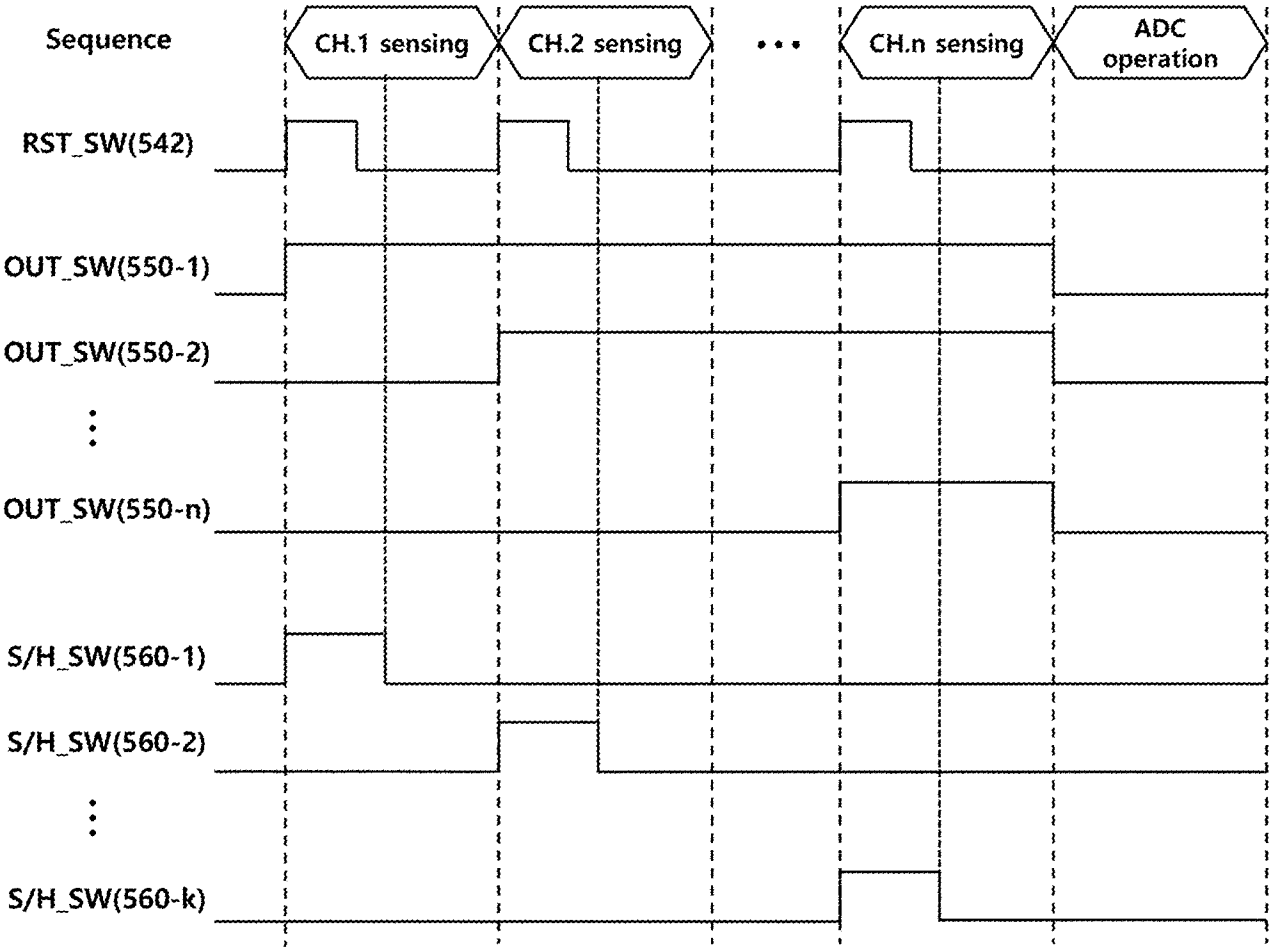

Specifically, when the first channel switch 520-1 and the first current input switch 530-1 are closed, a reset switch 542 of the common current integrator circuit 540 is temporarily closed as shown in FIG. 8. Accordingly, the common current integrator circuit 540 is initialized. Here, the common current integrator circuit 540 may output a reference voltage Vref.

When the reset switch 542 is open in a state in which the first channel switch 520-1 and the first current input switch 530-1 are closed, the common current integrator circuit 540 may integrate the pixel current characteristic input through the first sensing channel, thereby outputting a first integral value.

Subsequently, when the first channel switch 520-1 is open and the second channel switch 520-2 and the second current input switch 530-2 are closed, the reset switch 542 is temporarily closed, and accordingly the common current integrator circuit 540 is initialized again. Here, the first current input switch 530-1 maintains a closed state.

When the reset switch 542 is open in a state in which the second channel switch 520-2, the first current input switch 530-1, and the second current input switch 530-2 are closed, the common current integrator circuit 540 may integrate the pixel current characteristic input through the second sensing channel, thereby outputting a second integrated value.

The common current integrator circuit 540 may repeatedly perform the foregoing operation, thereby sequentially integrating the pixel current characteristics input through the first sensing channel 510-1 to the kth sensing channel **510-*k*. Here, an integral value output from the common current integrator circuit 540** may be a voltage value.

As illustrated in FIG. 6, the integral output switch circuit 550 may include a first integral output switch 550-1 and a second integral output switch 550-2 to a kth integral output switch **550-*k*. Here, one portion of the first integral output switch 550-1 may be connected to an output portion of the common current integrator circuit 540, and the other portion of the first integral output switch 550-1 may be connected to one portion of the second integral output switch 550-2. The other portion of the second integral output switch 550-2** may be connected to one portion of the third integral output switch (not shown).

According to an embodiment, in the current sensing mode, the integral output switch circuit 550 may electrically connect the output portion of the common current integrator circuit 540 and the plurality of sample-and-hold circuits 560 and may then disconnect the same. Here, the integral output switch circuit 550 may sequentially connect the output portion of the common current integrator circuit 540 and the plurality of sample-and-hold circuits 560 and may then simultaneously disconnect the same.

In the voltage sensing mode, the integral output switch circuit 550 may electrically disconnect the output portion of the common current integrator circuit 540 and the plurality of sample-and-hold circuits 560.

Specifically, as illustrated in FIG. 8, in the current sensing mode, at a time when the first channel switch 520-1 and the first current input switch 530-1 are closed, the first integral output switch 550-1 may also be closed. Then, the first integral output switch 550-1 may continuously maintain a closed state, and may be open at a time when the kth channel switch **520-*k* and the kth current input switch 530-*k* are open. That is, the first integral output switch 550-1** may be electrically closed in the current sensing mode.

At a time when the second channel switch 520-2 and the second current input switch 530-2 are closed, the second integral output switch 550-2 may also be closed. Then, the second integral output switch 550-2 may continuously maintain a closed state, and may be open at a time when the kth channel switch **520-*k* and the kth current input switch 530-*k*** are opened.

At a time when the kth channel switch **520-*k*, which is the last switch of the channel switch circuit 520, and the kth current input switch 530-*k*, which is the last switch of the current input switch circuit 530, are closed, the kth integral output switch 550-*k* may also be closed. Then, when the kth channel switch 520-*k* and the kth current input switch 530-*k* are open after a lapse of a specified time (CH.k sensing section of FIG. 8), the kth integral output switch 550-*k*** may also be open.

In the voltage sensing mode, all of the first integral output switch 550-1 to the kth integral output switch **550-*k*** may maintain an open state.

As illustrated in FIG. 6, the plurality of sample-and-hold circuits 560 may include a first sample-and-hold circuit 560-1 and a second sample-and-hold circuit 560-2 to a kth sample-and-hold circuit **560-*k*. Here, each sample-and-hold circuit may include a sampling switch (see Si of FIG. 4**).

The plurality of sample-and-hold circuits 560 may be connected in parallel with the output portion of the common current integrator circuit 540 and may be connected to the plurality of sensing channels 510 one-to-one.

According to an embodiment, in the current sensing mode, the plurality of sample-and-hold circuits 560 sequentially samples and holds a plurality of integral values, that is, the first integral value to a kth integral value, sequentially output from the common current integrator circuit 540.

In the voltage sensing mode, the plurality of sample-and-hold circuits 560 sequentially samples and holds pixel voltage characteristics sequentially input through the voltage sensing path V_Path.

Specifically, as illustrated in FIG. 8, in the current sensing mode, at a time when the reset switch 542 and the first integral output switch 550-1 are closed, only a sampling switch of the first sample-and-hold circuit 560-1 among the plurality of sample-and-hold circuits 560 may be closed.

The sampling switch of the first sample-and-hold circuit 560-1 may be open after the reset switch 542 is open.

That is, when the common current integrator circuit 540 outputs the first integral value, the sampling switch of the first sample-and-hold circuit 560-1 among the plurality of sample-and-hold circuits 560 may be closed, and thus the first sample-and-hold circuit 560-1 may sample and hold the first integral value.

When the common current integrator circuit 540 outputs the second integral value, a sampling switch of the second sample-and-hold circuit 560-2 among the plurality of sample-and-hold circuits 560 may be closed, and thus the second sample-and-hold circuit 560-2 may sample and hold the second integral value.

Likewise, when the common current integrator circuit 540 outputs the kth integral value, a sampling switch of the kth sample-and-hold circuit **560-*k* among the plurality of sample-and-hold circuits 560 may be closed, and thus the kth sample-and-hold circuit 560-*k*** may sample and hold the kth integral value.

Through the operation of the integral output switch circuit 550 and the operation of the plurality of sample-and-hold circuits 560 described above, the plurality of integral values sequentially output from the common current integrator circuit 540 may be sequentially sampled and held in an order in which the integral values are output.

In the voltage sensing mode, the plurality of sample-and-hold circuits 560 may simultaneously operate. A detailed description will be provided when the voltage sensing switch circuit 570 is described.

Figure 9:
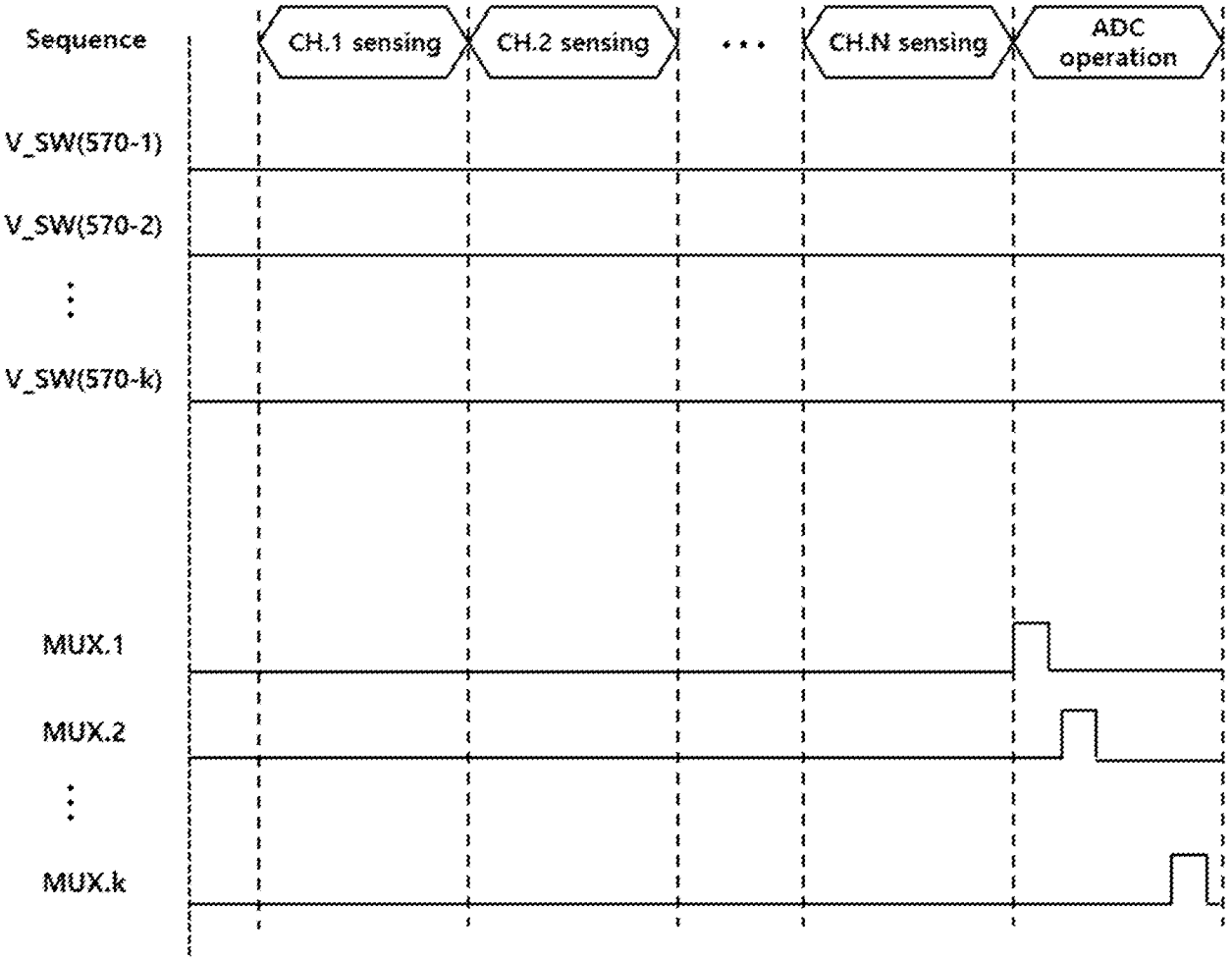

As illustrated in FIG. 9, in the current sensing mode, the voltage sensing switch circuit 570 may electrically disconnect the plurality of sample-and-hold circuits 560 and the plurality of sensing channels 510. That is, in the current sensing mode, the voltage sensing switch circuit 570 may maintain an open state as illustrated in FIG. 9.

In the voltage sensing mode, the voltage sensing switch circuit 570 may electrically connect the plurality of sample-and-hold circuits 560 and the plurality of sensing channels 510. Here, the voltage sensing switch circuit 570 may simultaneously connect the plurality of sample-and-hold circuits 560 and the plurality of sensing channels 510.

Specifically, in the voltage sensing mode, the first channel switch 520-1 to the kth channel switch **520-*k* included in the channel switch circuit 520 may be simultaneously closed. At the same time, a first voltage sensing switch 570-1 and a second voltage sensing switch 570-2 to a kth voltage sensing switch 570-*k* included in the voltage sensing switch circuit 570** may also be simultaneously closed.

In addition, all sampling switches of the plurality of sample-and-hold circuits 560 may be closed.

Accordingly, the plurality of pixel voltage characteristics input through the plurality of sensing channels 510 may be simultaneously input to the plurality of sample-and-hold circuits 560 and may be sampled and held. Here, the pixel voltage characteristics may include the voltage of a source node of the driving transistor DRT or the voltage of a drain node thereof.

The multiplexer 580 may receive the plurality of sampled integral values from the plurality of sample-and-hold circuits 560 and may sequentially output the plurality of sampled integral values to the analog-to-digital converter 590. That is, the multiplexer 580 may sequentially output the plurality of integral values to the analog-to-digital converter 590 in a multiple-input single-output mode.

Specifically, in the current sensing mode, after receiving the sampled first integral value to the sampled kth integral value from the first sample-and-hold circuit 560-1 to the kth sample-and-hold circuit **560-*k*, the multiplexer 580 may output the sampled first integral value to the analog-to-digital converter 590** and may then output the sampled second integral value, thereby sequentially outputting the plurality of sampled integral values.

In the voltage sensing mode, the multiplexer 580 may receive the plurality of sampled pixel voltage characteristics from the plurality of sample-and-hold circuits 560 and may sequentially output the plurality of sampled pixel voltage characteristics to the analog-to-digital converter 590.

The analog-to-digital converter 590 may digitally process the plurality of sampled integral values, thereby generating pixel sensing data S_DATA, which is digital data.

Further, the analog-to-digital converter 590 may digitally process the plurality of sampled pixel voltage characteristics, thereby generating pixel sensing data S_DATA.

As described above, since the current integrator circuit can be shared in the pixel sensing circuit 500 according to the embodiment, it is possible to reduce the size of the pixel sensing circuit 500 compared to a conventional art. Accordingly, it is also possible to reduce the size of a source driver IC including the pixel sensing circuit 500 may be reduced compared to a conventional art.

Figure 10:
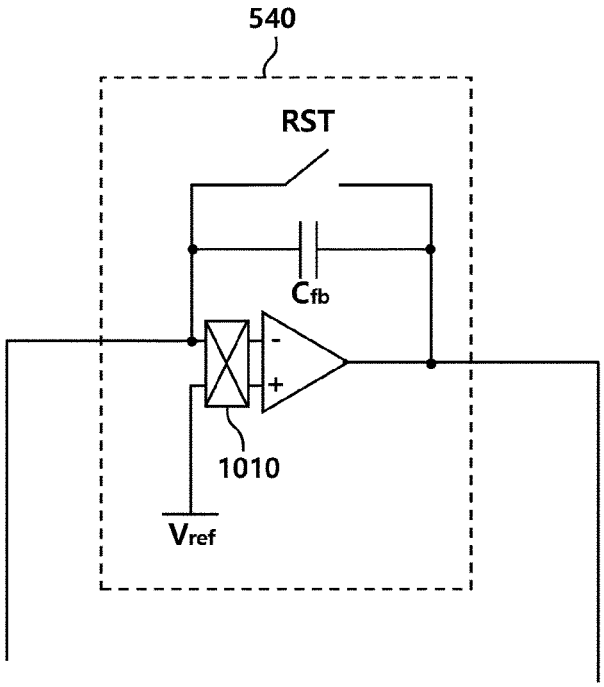
FIG. 10 illustrates a component additionally included in a current integrator circuit according to an embodiment.

In an embodiment, as illustrated in FIG. 10, an auto-zeroing circuit 1010 may be added to an input portion of the common current integrator circuit 540 in the pixel sensing circuit 500, thereby reducing the offset of the common current integrator circuit 540.

Figure 11:
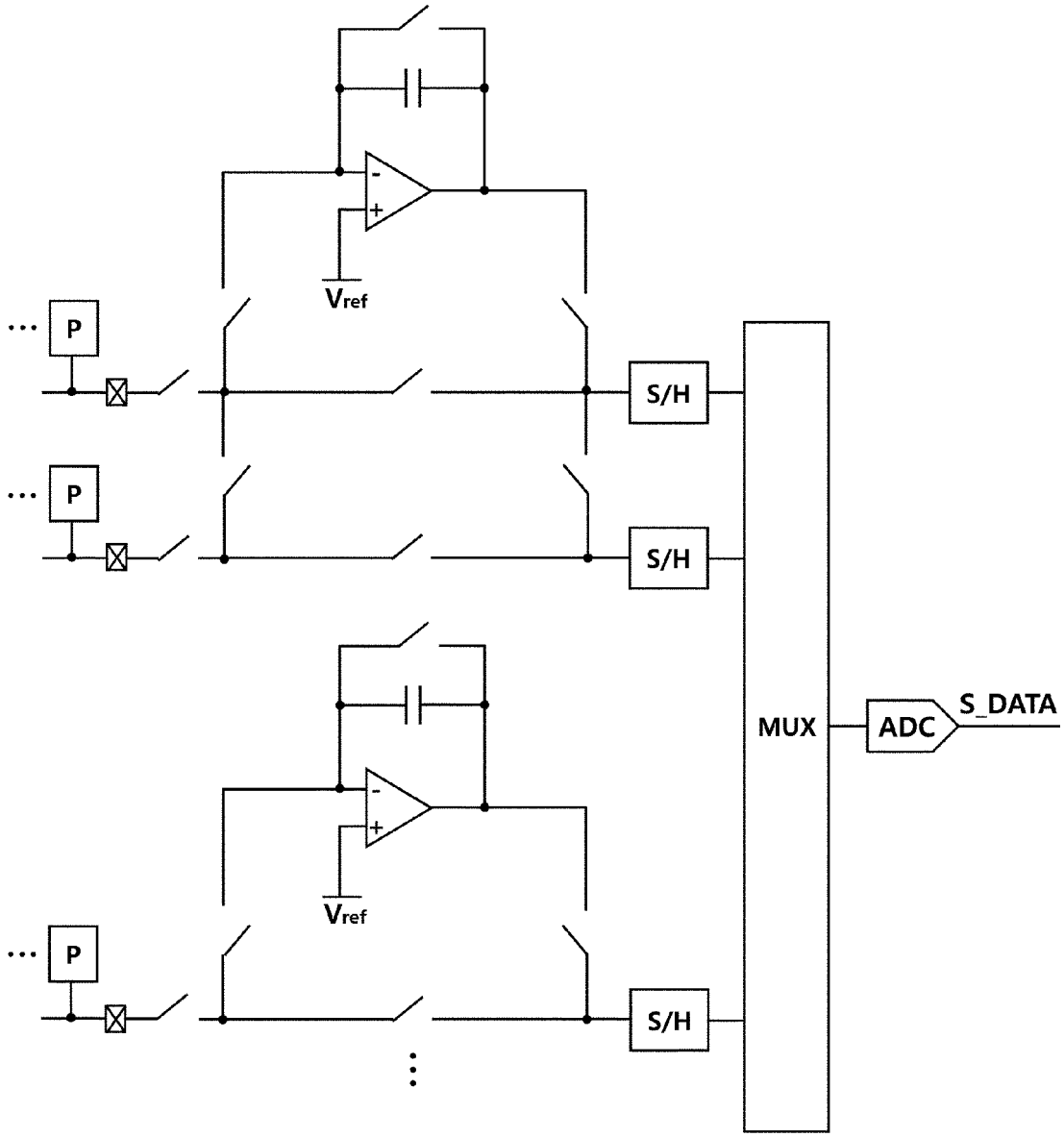
FIG. 11 illustrates a modified configuration of a pixel sensing circuit according to an embodiment.

Although FIG. 5 shows that one common current integrator circuit 540 is included in the pixel sensing circuit 500, the embodiment is not limited thereto, and two or more common current integrator circuits may be included in the pixel sensing circuit 500 as illustrated in FIG. 11.

When the pixel sensing circuit 500 includes two or more common current integrator circuits, the configuration according to the foregoing embodiment may be applied to each common current integrator circuit.

In an embodiment, the overall control of the pixel sensing circuit 500 may be performed by a controller (not shown) included in the source driver IC.

Hereinafter, a process in which the source driver IC including the pixel sensing circuit 500 senses a pixel will be described.

Figure 12:
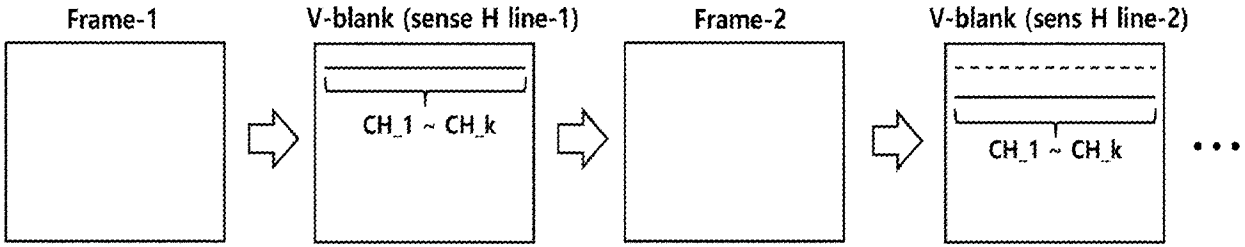
FIG. 12 illustrates a pixel sensing process of a general source driver IC.

FIG. 12 illustrates a pixel sensing process of a general source driver IC.

The general source driver IC in which a current integrator circuit is provided for each sensing channel can perform current sensing on a plurality of sensing channels at the same time, and thus current sensing time for the plurality of sensing channels may be shorter than a vertical blank period. Therefore, as illustrated in FIG. 12, the general source driver IC may sense all pixels included in one horizontal line in a vertical blank period of one frame period.

For example, all pixels in a first horizontal line may be sensed in a vertical blank period included in a first frame period, and all pixels in a second horizontal line may be sensed in a vertical blank period included in a second frame period.

However, the source driver IC according to the embodiment has the current integrator circuit shared in the pixel sensing circuit 500 and thus sequentially performs current sensing on the plurality of sensing channels 510. Accordingly, since current sensing time for the plurality of sensing channels 510 is longer than a vertical blank period, it is impossible to sense all pixels included in one horizontal line in a vertical blank period of one frame period.

Figure 13:
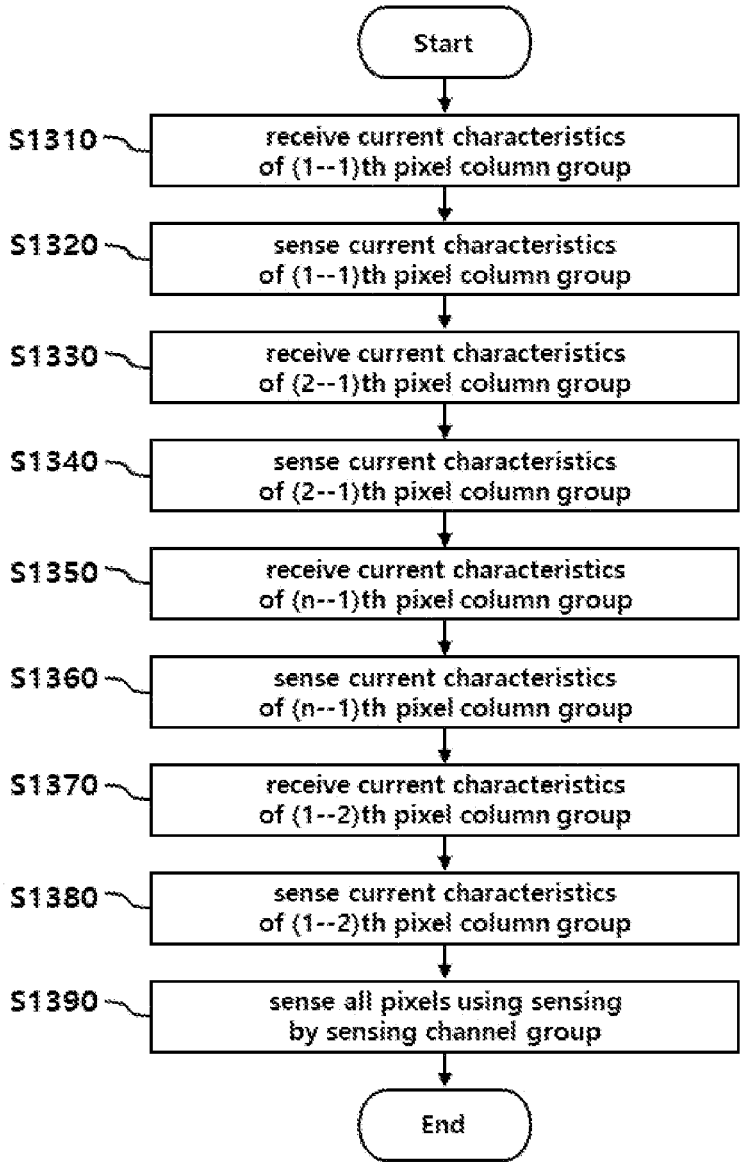
FIG. 13 is a flowchart illustrating a process in which a source driver IC senses pixels on a display panel according to an embodiment.

In an embodiment, to solve the above situation, the source driver IC performs a process illustrated in FIG. 13.

FIG. 13 is a flowchart illustrating a process in which a source driver IC senses pixels on a display panel according to an embodiment.

In the embodiment, the source driver IC may divide the plurality of sensing channels 510 into two or more sensing channel groups and may sense current characteristics of pixels in one horizontal line by a unit of a sensing channel group.

First, in a vertical blank period of a first frame, the source driver IC may receive current characteristics of a (1--1)th pixel column group, which is a first pixel column group in a first horizontal line, through a first sensing channel group (S1310). Here, a horizontal line may refer to a row on the display panel.

Subsequently, the source driver IC may sense the current characteristics of the (1--1)th pixel column group (S1320). Here, the source driver IC may sequentially integrate the current characteristics of the (1--1)th pixel column group to thereby generate integral values and may generate pixel sensing data, which is digital data including the integral values.

In a vertical blank period of a second frame, which is subsequent to the first frame, the source driver IC may receive current characteristics of a (2--1)th pixel column group, which is a first pixel column group in a second horizontal line, through the first sensing channel group (S1330).

The source driver IC may sense the current characteristics of the (2--1)th pixel column group (S1340). In S1340, the source driver IC may sequentially integrate the current characteristics of the (2--1)th pixel column group to thereby generate integral values and may generate pixel sensing data, which is digital data including the integral values.

The source driver IC may receive and sense current characteristics of a first pixel column group included in a corresponding horizontal line through the first sensing channel group in a vertical blank period of each of third to (N−1)th frames.

In a vertical blank period of an Nth frame (where N is a natural number equal to or greater than 2), the source driver IC may receive current characteristics of an (n--1)th pixel column group (where n is a natural number equal to N), which is a first pixel column group in an nth horizontal line, through the first sensing channel group (S1350). Here, the nth horizontal line may refer to the last horizontal line on the display panel.

After S1350, the source driver IC may sense the current characteristics of the (n--1)th pixel column group (S1360).

In a vertical blank period of an (N+1)th frame, which is subsequent to the Nth frame, the source driver IC may receive current characteristics of a (1--2)th pixel column group, which is a second pixel column group in the first horizontal line, through a second sensing channel group (S1370). Here, the (1--1)th pixel column group may include some pixels sequentially disposed in the first horizontal line, and the (1--2)th pixel column group may include some other pixels sequentially disposed after the foregoing pixels in the first horizontal line.

The first sensing channel group may include some sensing channels sequentially disposed in the source driver IC, and the second sensing channel group may include some other sensing channels sequentially disposed after the foregoing sensing channels in the source driver IC.

That is, the first sensing channel group may include two or more sensing channels sequentially disposed among the plurality of sensing channels, and the second sensing channel group may include two or more sensing channels sequentially disposed after the first sensing channel group.

After S1370, the source driver IC may sense the current characteristics of the (1--2)th pixel column group (S1380).

The source driver IC may sense all the pixels on the display panel through the foregoing sensing by each sensing channel group (S1390).

An example of the above process is as follows.

Figure 14:
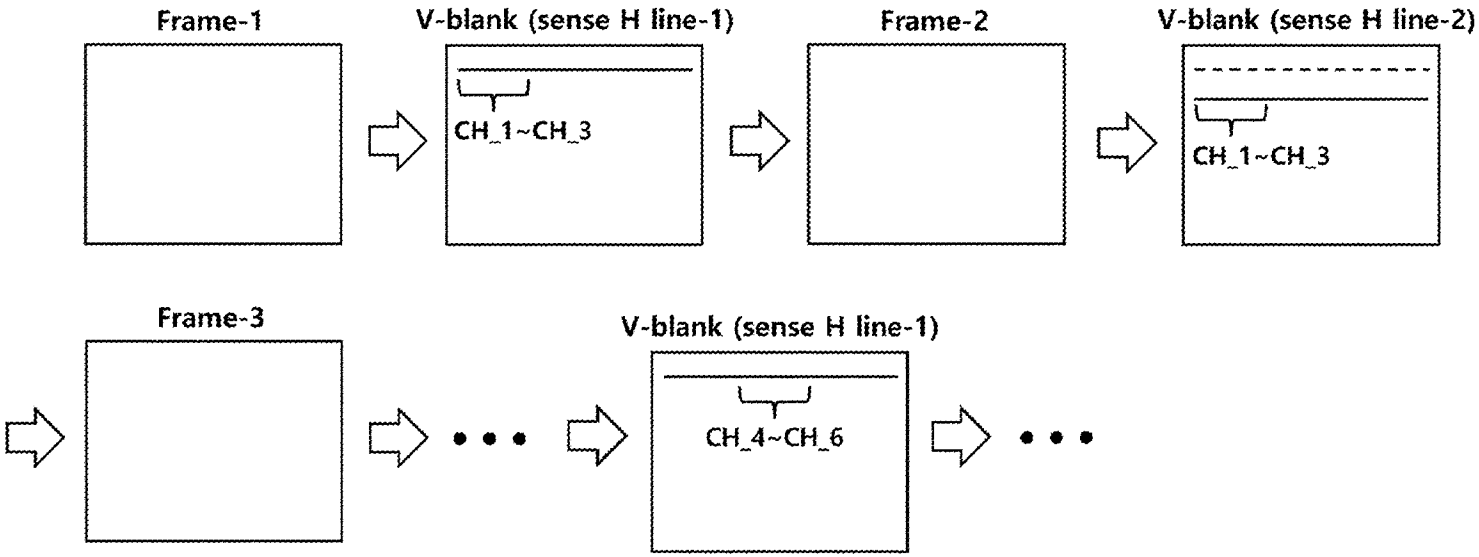
FIG. 14 illustrates a pixel sensing process of a source driver IC according to an embodiment.

FIG. 14 illustrates a pixel sensing process of a source driver IC according to an embodiment.

For example, when one sensing channel group includes three sensing channels sequentially disposed and a (1--1)th pixel column group includes pixels which are connected to a first sensing channel CH_1 to a third sensing channel CH_3 in a first sensing channel group in a first horizontal line, the source driver IC receives current characteristics of only the (1--1)th column group rather than all pixels in the first horizontal line through the first sensing channel group (the first sensing channel to the third sensing channel) in a vertical blank period of a first frame.

After sensing the current characteristics of the (1--1)th pixel column group, the source driver IC receives current characteristics of only a (2--1)th pixel column group rather than all pixels in a second horizontal line through the first sensing channel group (the first sensing channel to the third sensing channel) in a vertical blank period of a second frame. Here, the (2--1)th pixel column group refers to pixels connected to the first sensing channel group in the second horizontal line.

In a vertical blank period of an Nth frame, the source driver IC receives and senses current characteristics of only an (n--1)th pixel column group in an nth horizontal line through the first sensing channel group (the first sensing channel to the third sensing channel). Here, the nth horizontal line refers to the last horizontal line.

Subsequently, in a vertical blank period of an (N+1)th frame, the source driver IC receives and senses current characteristics of only a (1--2)th pixel column group which are connected to a second sensing channel group (fourth sensing channel to sixth sensing channel) in the first horizontal line through the second sensing channel group (the fourth sensing channel to the sixth sensing channel).

As described above, the source driver IC according to the embodiment may sense pixels in each horizontal line by a unit of a sensing channel group in each vertical blank period of each frame.

What is claimed is:

1. A pixel sensing circuit, comprising:

at least two sensing channels configured to comprise a first sensing channel connected to a first sensing line on a display panel and a second sensing channel connected to a second sensing line on the display panel;

a current integrator circuit configured to output a first integral value by integrating a pixel current characteristic input through the first sensing channel and then to output a second integral value by integrating a pixel current characteristic input through the second sensing channel;

at least two sample-and-hold circuits configured to be connected in parallel with an output portion of the current integrator circuit and to be connected with the at least two sensing channels one-to-one;

a voltage sensing switch circuit configured to electrically disconnect the at least two sample-and-hold circuits and the at least two sensing channels in a current sensing mode in which the current integrator circuit sequentially outputs the first integral value and the second integral value and electrically connect the at least two sample-and-hold circuits and the at least two sensing channels in a voltage sensing mode in which at least two pixel voltage characteristics, input through the at least two sensing channels, are sampled and held by the at least two sample-and-hold circuits;

an integral output switch circuit configured to comprise a first integral output switch, one portion of which is connected to the output portion of the current integrator circuit, which is electrically closed in the current sensing mode, and which is electrically open in the voltage sensing mode; and a second integral output switch, one portion of which is connected to another portion of the first integral output switch, which is electrically open when the current integrator circuit outputs the first integral value and is electrically closed when the current integrator circuit outputs the second integral value in the current sensing mode, and which is electrically open in the voltage sensing mode.

2. The pixel sensing circuit of claim 1, wherein, when the current integrator circuit outputs the first integral value, a sampling switch of a first sample-and- hold circuit among the at least two sample-and-hold circuits is closed so that the first sample- and-hold circuit samples and holds the first integral value, and when the current integrator circuit outputs the second integral value, a sampling switch of a second sample-and-hold circuit among the at least two sample-and-hold circuits is closed so that the second sample-and-hold circuit samples and holds the second integral value.

3. The pixel sensing circuit of claim 2, further comprising a multiplexer configured to:

receive the sampled first integral value from the first sample-and-hold circuit, receive the sampled second integral value from the second sample-and-hold circuit, output the sampled first integral value to an analog-to-digital converter (ADC), and then output the sampled second integral value to the analog-to-digital converter in the current sensing mode; and receive the at least two pixel voltage characteristics sampled and held from the at least two sample-and-hold circuits and sequentially output the at least two pixel voltage characteristics to the analog-to-digital converter in the voltage sensing mode.

4. The pixel sensing circuit of claim 1, further comprising a current input switch circuit configured to comprise:

a first current input switch, one portion of which is connected to an input portion of the current integrator circuit, which is electrically closed in the current sensing mode, and which is electrically open in the voltage sensing mode; and a second current input switch, one portion of which is connected to another portion of the first current input switch, which is electrically open when the current integrator circuit outputs the first integral value and is electrically closed when the current integrator circuit outputs the second integral value in the current sensing mode, and which is electrically open in the voltage sensing mode.

5. The pixel sensing circuit of claim 1, wherein each of the at least two pixel voltage characteristics comprises a voltage of a source node or a drain node of a thin-film transistor (TFT) included in a pixel.

6. The pixel sensing circuit of claim 1, wherein the pixel current characteristic comprises a source-drain current flowing in a thin-film transistor (TFT) included in a pixel.

7. A method for sensing pixels on a display panel by a source driver integrated circuit (IC), the method comprising:

a first input operation of receiving current characteristics of a (1--1)th pixel column group, which is a first pixel column group in a first horizontal line, through a first sensing channel group in a vertical blank period of a first frame;

a first sensing operation of sensing the current characteristics of the (1--1)th pixel column group;

an Nth input operation of receiving current characteristics of an (n--1)th pixel column group (where n is a natural number equal to N), which is a first pixel column group in an nth horizontal line, through the first sensing channel group in a vertical blank period of an Nth frame (where N is a natural number equal to or greater than 2);

an Nth sensing operation of sensing the current characteristics of the (n--1)th pixel column group;

an (N+1)th input operation of receiving current characteristics of a (1--2)th pixel column group, which is a second pixel column group in the first horizontal line, through a second sensing channel group in a vertical blank period of an (N+1)th frame; and an (N+b 1)th sensing operation of sensing the current characteristics of the (1--2)th pixel column group, wherein the source driver IC, comprises:

a first sensing channel and a second sensing channel included in the first sensing channel group;

a current integrator circuit configured to output a first integral value by integrating a pixel current characteristic input through the first sensing channel and then to output a second integral value by integrating a pixel current characteristic input through the second sensing channel;

a first sample-and-hold circuit and a second sample-and hold circuit configured to be connected in parallel with an output portion of the current integrator circuit and to be connected with the first sensing channel and the sensing channel one-to-one;

a first integral output switch, one portion of which is connected to the output portion of the current integrator circuit, which is electrically closed when the current integrator circuit outputs the first integral value and the second integral value;

a second integral output switch, one portion of which is connected to the another portion of the first integral output switch, which is electrically open when the current integrator circuit outputs the first integral value and is electrically closed when the current integrator circuit outputs the second integral value;

wherein, when the current integrator circuit outputs the first integral value, the first sample-and-hold circuit samples and holds the first integral value, and when the current integrator circuit outputs the second integral value, the second sample-and-hold circuit samples and holds the second integral value.

8. The method of claim 7, wherein the (1--1)th pixel column group comprises some pixels sequentially disposed in the first horizontal line, and the (1--2)th pixel column group comprises some other pixels sequentially disposed after the some pixels in the first horizontal line.

9. The method of claim 7, wherein the first sensing channel group comprises some sensing channels sequentially disposed in the source driver IC, and the second sensing channel group comprises some other sensing channels sequentially disposed after the some sensing channels in the source driver IC.

10. The method of claim 7, wherein the first sensing operation comprises:

generating integral values by sequentially integrating the current characteristics of the (1--1)th pixel column group; and generating pixel sensing data, which is digital data comprising the integral values.

11. The method of claim 7, wherein, in the Nth input operation, the nth horizontal line is a last horizontal line on the display panel.

* * * * *